US005341514A

United States Patent [19]

Dale

[11] Patent Number: 5,341,514

[45] Date of Patent: Aug. 30, 1994

[54] JACKET EXTENDER TO ENLARGEN THE CIRCUMFERENCE OF A JACKET

[76] Inventor: Thomas E. Dale, 327 14th Ave. SE., Minneapolis, Minn. 55414

[21] Appl. No.: 24,469

[22] Filed: Mar. 1, 1993

[51] Int. Cl.[5] ..... A41D 3/02

[52] U.S. Cl. ..... 2/96; 2/108; 2/106; 2/85

[58] Field of Search ..... 2/96, 108, 106, 85, 2/93, 94, 270, 102

[56] References Cited

U.S. PATENT DOCUMENTS

| | | | |
|---|---|---|---|
| 2,636,176 | 4/1953 | Ross | 2/93 |
| 3,092,840 | 6/1963 | Roberts | 2/96 |
| 3,094,703 | 6/1963 | Bailey | 2/96 |
| 3,230,545 | 1/1966 | Galley | 2/96 |

FOREIGN PATENT DOCUMENTS

| | | | |
|---|---|---|---|
| 506013 | 10/1951 | Belgium | 2/96 |
| 60992 | 2/1955 | France . | |
| 1473276 | 2/1967 | France | 2/96 |

*Primary Examiner*—Clifford D. Crowder
*Assistant Examiner*—Gloria Hale
*Attorney, Agent, or Firm*—Burd, Bartz & Gutenkauf

[57] ABSTRACT

A garment made of relatively expensive material for the upper body of a person having a front opening suitable for use in environments of mild and cold temperatures. The elongated web extender having a uniform width can be releasably joined to the sides of the garment adjacent the front opening to expand the circumferential size of the garment whereby additional layers of clothing can be worn underneath the garment during colder weather. Each side of the web extender has a releasable connector assembly attached thereto. A first connector assembly is associated with a closure device used to join the first connector assembly and a complimentary connector assembly on one side of a garment. The second connector assembly on the web extender has an end that cooperates with a closure device associated with a releasable connector assembly attached to the opposite side of the garments to join the connector assemblies and close the front opening of the garment.

19 Claims, 1 Drawing Sheet

JACKET EXTENDER TO ENLARGEN THE CIRCUMFERENCE OF A JACKET

FIELD OF INVENTION

The invention relates to articles of clothing desired to be worn in both mild and cold climates. The clothing articles include structures that expand the circumferential dimensions thereof.

BACKGROUND OF INVENTION

A common problem among persons who wear fashionable, expensive garments, such as leather jackets, is one of year round use of the garment. Leather jackets, which cost up to $800 each, are worn by many people including persons associated with a variety of groups, particularly, biker groups, team sport groups and other recreational groups. These jackets are desired to be worn year round as symbols of group association. The jackets are generally tailored to fit generally close to the body of the wearers. During periods of warmer weather these garments can be worn comfortably over minimal layers of clothing. However, when outside temperatures reach sub-freezing, additional layers of clothing are necessary to maintain body heat. In cold weather, the jackets cannot be comfortably worn over additional layers of clothing. The cost of purchasing these types of outer garments in a variety of sizes is likely to be prohibitive to most consumers.

In the past, devices have been used as alternatives to maternity clothes and clothing for overweight persons. Cash, in U.S. Pat. No. 4,683,595, teaches convertible maternity wear using a triangular panel that is attachable to the main body of the garment to increase the girth thereof in the abdominal area of the garment. Reardon, in U.S. Pat. No. 5,163,184, discloses a flae of material that can be fastened to a garment or worn about the waist of a person to expand the waist size of the garment. The prior art fails to provide a jacket which can be worn by a person if desired in both mild and cold weather environments in a fashionable and comfortable manner.

SUMMARY OF INVENTION

The invention is directed to a jacket for use in year round conditions. An elongated web member can be attached to or removed from the jacket to vary the circumferential size of the jacket according to the outside temperatures and layers of clothing being worn.

The jacket has a first body section having a first releasable connector assembly and a second body section having a second releasable connector assembly. A first closure member is movably mounted on the second connector assembly. An elongated web extender having a substantially uniform width through its length is removably attachable to both body sections of the jacket to vary the circumferential size of the jacket. The web extender has first and second sides that are generally parallel relative to each other. A third releasable connector assembly is attached to the first side of the web extender. The second side of the web extender has a fourth releasable connector assembly attached thereto. The fourth connector assembly has a lower end member that accommodates the first closure member and orients the connector assemblies on the second body section and the second side of the web extender relative to each other. Moving the first closure member in an upward direction holds the second and fourth connector assemblies in a closed position and connects the second body section to the second side of the web extender.

A second closure member is movably mounted on the third connector assembly joined to the first side of the web extender. The first connector assembly on the first body section of the jacket has a lower end member that accommodates the second closure member and orients the connector assemblies on the first body section and the first side of the web extender relative to each other. Moving the second closure member in an upward direction holds the first and third connector assemblies in a closed position connecting the first body section of the jacket to the first side of the web extender.

The web extender has a substantially uniform width and length. The length-to-width ratio of the web extender is approximately 10:1. The connector assemblies attached to the sides of the web extender extend the full length of the web extender and are generally parallel relative to each other. The thicknesses of the web extender and the first and second body sections are substantially uniform. Also, the material of the exterior layers of the web extender and jacket body sections are substantially the same, such as leather material.

DESCRIPTION OF PREFERRED EMBODIMENT

Figure 1:
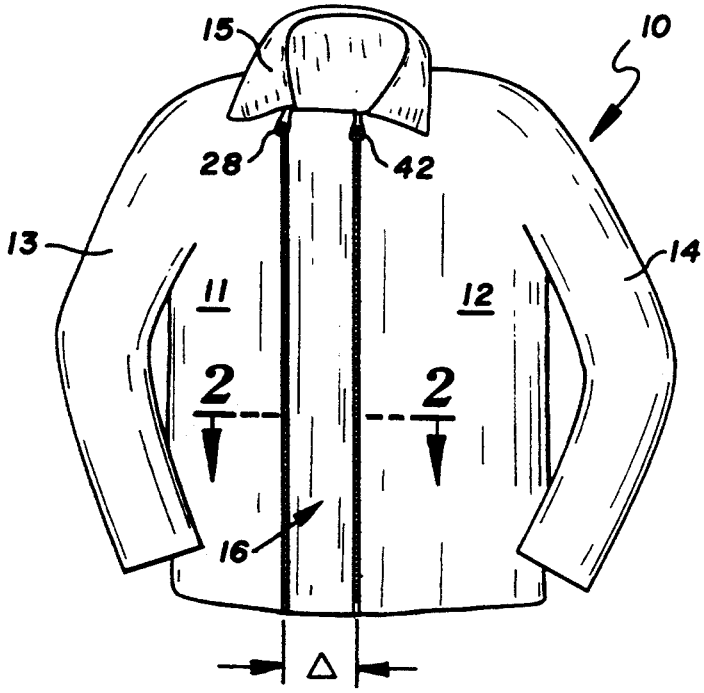
FIG. 1 is a front elevational view of a jacket equipped with the web extender of the invention.

Referring to FIG. 1, there is shown an article of clothing or garment for a person suitable for use in mild and cold weather environments. The garment is a jacket, indicated generally at 10, having front body sections 11 and 12 joined at their upper ends to elongated generally tubular arms 13 and 14. The top of the jacket has a conventional collar 15. Jacket 10 has a leather exterior and a fabric liner. Other types of materials including fabrics, synthetic plastics and vinyls can be used for the exterior and liner of jacket 10. Other types of garments can be used with the web extender of the invention including but not limited to snow suits, sweaters, shirts and under garments for males and females.

An elongated web extender, indicated generally at 16, is interposed between front sections 11 and 12 to increase the circumferential dimension of jacket 10. Jacket 10 is usable in warmer climates without the web extender. In cold environments, such as Minnesota, additional layers of bulk clothing are usually worn under jacket 10 with the use of web extender 16. Layering of clothes is an effective way of maintaining body heat in below zero temperatures.

Figure 2:
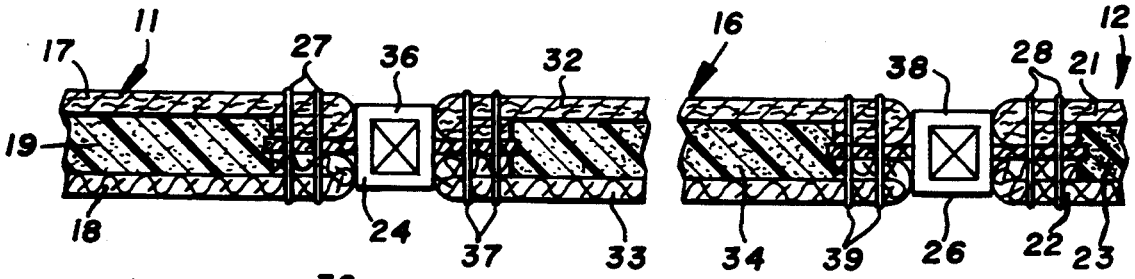
FIG. 2 is an enlarged sectional view taken along the line 2—2 of FIG. 1.

Referring to FIG. 2, front section 11 has an outer layer of a leather member 17 and an inner fabric liner 18. Interposed between outer member 17 and liner 18 is one or more layers of core material 19, such as foam, plastic or fabric. Section 12 has the same structure, including outer leather member 21, inner liner 22 and a core 23 interposed between leather member 21 and liner 22.

Figure 3:
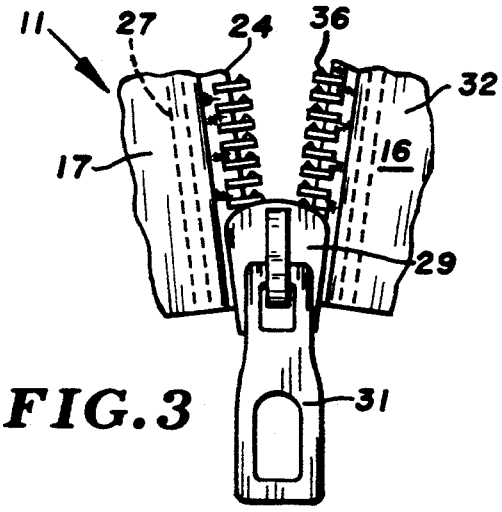
FIG. 3 is an enlarged front elevational view of the opened releasable connector assembly and closure slide.

A releasable connector assembly comprising an elongated strip having teeth, commonly known as a zipper 24, is attached with stitching 27 to leather member 17 and fabric liner 18. The complimentary releasable connector assembly 26 is connected with stitching 28 to leather member 21 and liner 22. A movable closure slide 29, as shown in FIG. 3, is used to connect strips 24 and 26 without the use of web extender 16. Closure slide 29 includes tab 31, which serves as a finger grip, to allow the user to conveniently move closure slide 29 between its up, closed position and down, open position.

Figure 4:
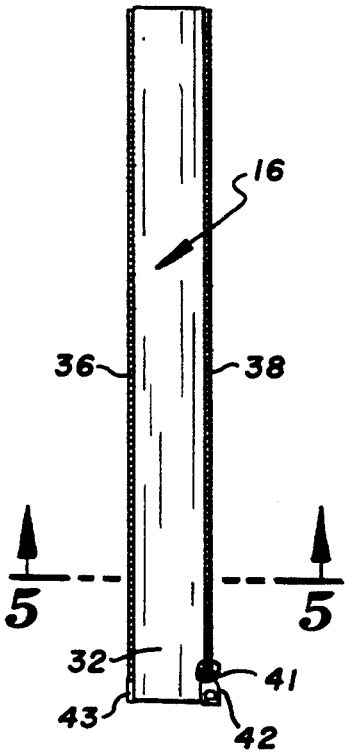
FIG. 4 is an enlarged front elevational view of the web extender.
Figure 5:
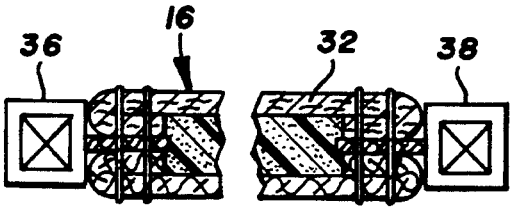
FIG. 5 is a sectional view taken along the line 5—5 of FIG. 4.

Referring to FIGS. 2, 4 and 5, web extender 16 has substantially uniform width throughout its length to provide for an increase in uniform circumferential jacket size throughout the length of the body of the jacket. Other web extenders having uniform widths that are different from the uniform width of extender 26 can be interposed between sections 11 and 12 to vary the circumferential dimension of jacket 10. The length-to-width ratio of extender 16 is approximately 10:1. Extender 16 can have other length-to-width ratios to increase or decrease the circumferential size of the jacket. The outer layer of extender 16 is leather member 32. Other types of materials, including fabrics, synthetic plastics and vinyls can be used for the outer layer of extender 16. Preferably, the material of extender 16 is the same as the material of the exterior of jacket 10. An inner liner 33 encloses a core 34, such as foam, plastic or fabric, so that web extender 16 has substantially the same thickness as front sections 11 and 12 of jacket 10. A releasable connector strip 36, known as a zipper, is attached with stitches 37 along one side of extender 16. A second releasable connector assembly strip 38 is connected with stitches 39 to the opposite side of extender 16. Strips 36 and 38 extend the full length of extender 16 and are generally parallel to each other. A closure slide 41 is associated with strip 38. Closure slide 41 has a tab 42 to provide for a convenient finger grip so that the user can move slide 41 to the up, closed position and the down, open position to open and close the jacket having web extender 16. The releasable connector assemblies 26 and 36 have the conventional rigid end 43 which accommodates the slide to orient teeth of the releasable connector assemblies relative to each other so that upon movement of the slides 29 and 41 in an upward direction, the teeth inter engage with each to hold the releasable connector assembly in the closed position. When slides 29 and 41 are moved down, web extender 16 has releasable connector assemblies that are open so that extender 16 can be removed from jacket 10.

Jacket 10 can be used in both warm and cold environments. In a warm environment, web extender 16 is removed from jacket 10 so that the circumferential dimension of the jacket fits the body of the user person. In cold weather, the person usually wears additional undergarments, such as shirts and sweaters. Web extender 16 is attached with releasable connector assemblies 36 and 38 to connector assembly strips 24 and 26, respectfully. Slides 29 and 41 are used to selectively open and close the releasable connector assemblies to open and close the jacket or remove web extender 16 from jacket 10.

While there has been shown and described a preferred embodiment of the jacket and web extender of the invention, it is understood that changes in the materials, structures and arrangement of structures may be made by those skilled in the art without departing from the invention. The invention is defined in the following claims.

I claim:

1. A leather jacket comprising: a first body section having first releasable connector means, a second body section having second releasable connector means, extender means attachable to the first and second body sections at a front portion of the jacket to increase a circumferential dimension of the jacket to an extended position allowing a user person to wear addition garments under the jacket, the extender means removable from the first and second body sections to decrease the circumferential dimension of the jacket to an unextended position to substantially fit the body of the user person, the extender means having an inside layer, an outside layer, core material interposed between the inside and outside layers, a first side and second side generally parallel to the first side, third releasable connector means attached to the first side of the extender means, fourth releasable connector means attached to the second side of the extender means, first closure means movably mounted on the second connector means, the fourth connector means having an end member engageable with the first closure means to orient the second and fourth connector means relative to each other whereby upon movement of the first closure means in an upward direction, the second and fourth connector means are held in a closed position, second closure means movably mounted on the third connector means, the first connector means having an end member engageable with the second closure means to orient the first and third connector means relative to each other whereby upon movement of the second closure means in an upward direction, the first and third connector means are held in a closed position thereby increasing the circumferential dimension of the jacket to the extended position.

2. The jacket of claim 1 wherein: the extender means has a substantially uniform width and length.

3. The jacket of claim 1 wherein: the extender means has a length-to-width ratio of 10:1.

4. The jacket of claim 1 wherein: the third and fourth connector means extend a full length of the extender means and are generally parallel relative to each other.

5. The jacket of claim 1 wherein: the extender means has a thickness substantially the same as the thickness of the first and second body sections.

6. The jacket of claim 1 wherein: the extender means has an outer layer made of a material substantially the same as materials of exterior layers of the first and second body sections.

7. A jacket comprising: a body having a first side and a second side generally parallel to the first side thereof, the first side having a first releasable connector means, the second side having a second releasable connector means, first closure means movably mounted on the first connector means, the first closure member engageable with the second connector means to hold the jacket at a selected circumferential size, extender means removably attached to the first and second sides of the body to increase the circumferential size of the jacket to an extended position, the extender means having an inside layer, an outside layer, core material interposed between the inside and outside layers, a first side and a second side generally parallel to the first side thereof, the second side of the extender means having a third releasable connector means, the second side of the extender means having a fourth releasable connector means, second closure member movably mounted on the third connector means, the fourth connector means having a lower end member engageable with the first closure member to vertically align the first connector means with the fourth connector means whereby upon movement of the first closure member in an upward direction the second side of the extender means is connected to the first side of the body, the second connector means having a lower end member engageable with the second closure member to vertically align the second connector means with the third connector means whereby upon movement of the second closure member in an upward direction the first side of the extender means is connected to the second side of the body thereby increasing the circumferential size of the jacket to the extended position.

8. The jacket of claim 7 wherein: the extender means has a substantially uniform width and length.

9. The jacket of claim 7 wherein: the extender means has a length-to-width ratio of 10:1.

10. The jacket of claim 7 wherein: the first and second connector means extend a full length of the extender means.

11. The jacket of claim 7 wherein: the first and second connector means are generally parallel relative to each other.

12. The jacket of claim 7 wherein: the extender means has a thickness substantially the same as thicknesses of the left side body section and right side body section.

13. The jacket of claim 7 wherein: the extender means has an outer layer made of a material substantially the same as materials of exterior layers of the left side body section and right side body section.

14. A jacket comprising: a body having a first side and a second side, the first side having a first releasable connector means, first closure member movably mounted on the first connector means, the second side having a second releasable connector means, extender means removably attachable to the first and second sides of the body to increase a circumferential size of the jacket to an extended position, the extender means removable from the first and second sides of the body to decrease the circumferential size of the jacket to an unextended position to substantially fit the body of a user person, the extender means having an inside layer, an outside later, core material interposed between the inside and outside layer, a first side and a second side generally parallel to the first side thereof, the first side of the extender means having a third releasable connector means, the second side of the extender means having a fourth releasable connector means, second closure member movably mounted on the third connector means, the fourth connector means having a lower end member accommodating the first closure member to orient the first connector means and the fourth connector means whereby when the first closure member is moved in an upward direction the second side of the extender means is connected to the first side of the body, the second connector means having a lower end member accommodating the second closure member to orient the second connector means whereby when the second closure member is moved in an upward direction the first side of the extender means is connected to the second side of the body thereby increasing the circumferential size of the jacket to the extended position allowing the user person to wear additional garments under the jacket.

15. The jacket of claim 14 wherein: the extender means has a substantially uniform width.

16. The jacket of claim 14 wherein: the extender means has a length-to-width ratio of 10:1.

17. The jacket of claim 14 wherein: the first and second connector means extend a full length of the extender means and are generally parallel relative to each other.

18. The jacket of claim 14 wherein: the extender means has a thickness substantially the same as thicknesses of the left side body section and right side body section.

19. The jacket of claim 14 wherein: the extender means has an outer layer made of a material substantially the same as materials of exterior layers of the left side body section and right side body section.

* * * * *